US007300390B1

(12) United States Patent
Krull

(10) Patent No.: US 7,300,390 B1
(45) Date of Patent: Nov. 27, 2007

(54) WEIGHT SELECTION METHODS AND APPARATUS

(76) Inventor: Mark A. Krull, P.O. Box 7198, Bend, OR (US) 97708

( * ) Notice: Subject to any disclaimer, the term of this patent is extended or adjusted under 35 U.S.C. 154(b) by 517 days.

(21) Appl. No.: 10/941,339

(22) Filed: Sep. 14, 2004

(51) Int. Cl.
*A63B 21/072* (2006.01)
*A63B 21/075* (2006.01)

(52) U.S. Cl. ..... 482/108; 482/107

(58) Field of Classification Search ..... 482/93–101, 482/106–108
See application file for complete search history.

(56) References Cited

U.S. PATENT DOCUMENTS 6,402,666 B2 * 6/2002 Krull ..... 482/107
6,422,979 B1 * 7/2002 Krull ..... 482/98
6,656,093 B2 * 12/2003 Chen ..... 482/108

* cited by examiner

*Primary Examiner*—Fenn C. Mathew

(57) ABSTRACT

Weight selecting members are movably mounted on a handle assembly and selectively rotatable into engagement with respective weight plates to provide adjustable resistance to exercise movement. The weight selecting members rotate into and out of notches associated with any combination of the weight plates.

20 Claims, 8 Drawing Sheets

WEIGHT SELECTION METHODS AND APPARATUS

FIELD OF THE INVENTION

The present invention relates to exercise equipment and more particularly, to weight selection methods and apparatus suitable for use in connection with exercise dumbbells.

BACKGROUND OF THE INVENTION

Various weight selection methods and apparatus have been developed to provide adjustable resistance to exercise. In the case of free weights, for example, weight plates are typically mounted on opposite ends of a bar. In relatively advanced systems, the bar is stored in proximity to the weight plates, and one or more selection mechanisms are provided to connect a desired amount of weight to the bar. Some examples of patented barbell/dumbbell improvements and/or features are disclosed in U.S. Pat. No. 4,284,463 to Shields (discloses a dumbbell assembly having opposite side weights that are maintained in alignment on a base and selectively connected to a handle by means of cam driven pins on the weights); U.S. Pat. No. 4,529,198 to Hettick, Jr. (discloses a barbell assembly having opposite side weights that are maintained in alignment on respective storage members and selectively connected to a handle by means of axially movable springs); U.S. Pat. No. 4,822,034 to Shields (discloses both barbell and dumbbell assemblies having opposite side weights that are maintained in alignment on a shelf and selectively connected to a handle by means of latches on the weights); U.S. Pat. No. 5,769,762 to Towley, III et al. (discloses a dumbbell assembly having a plurality of interconnected opposite side weights that are stored in nested relationship to one another and selectively connected to a handle by various means); U.S. Pat. No. 5,839,997 to Roth et al. (discloses a dumbbell assembly having opposite side weights that are maintained in alignment on a base and selectively connected to a handle by means of eccentric cams on a rotating selector rod; and U.S. Pat. No. 6,749,547 to Krull (discloses a dumbbell assembly having opposite side weights that are maintained in alignment on a base and selectively connected to a handle by means of respective rotating catches. Despite these advances and others in the field of weight selection, room for improvement remains.

SUMMARY OF THE INVENTION

One aspect of the present invention is to provide weight selecting members that are rotatably mounted on respective ends of a bar, and selectively rotatable into notches in more than one weight plate maintained in axial alignment with the bar. A hand grip is mounted on an intermediate portion of the bar to facilitate lifting of the bar and any weights connected to the bar by the weight selectors. Many features and/or advantages of the present invention will become apparent from the more detailed description that follows.

BRIEF DESCRIPTION OF THE FIGURES OF THE DRAWING

With reference to the Figures of the Drawing, wherein like numerals represent like parts throughout the several views.

DETAILED DESCRIPTION OF THE PREFERRED EMBODIMENT

The present invention provides methods and apparatus for selectively adjusting weight resistance to exercise motion, and relevant information regarding variations and/or applications for the present invention may be found in U.S. Pat. Nos. 6,629,910 and 6,749,547 to Krull, which are incorporated herein by reference. Generally speaking, weight selecting members 150 are rotatable into and out of engagement with notches in associated weight plates 160 and 170 to select any desired number or combination of the weight plates.

Figure 2:
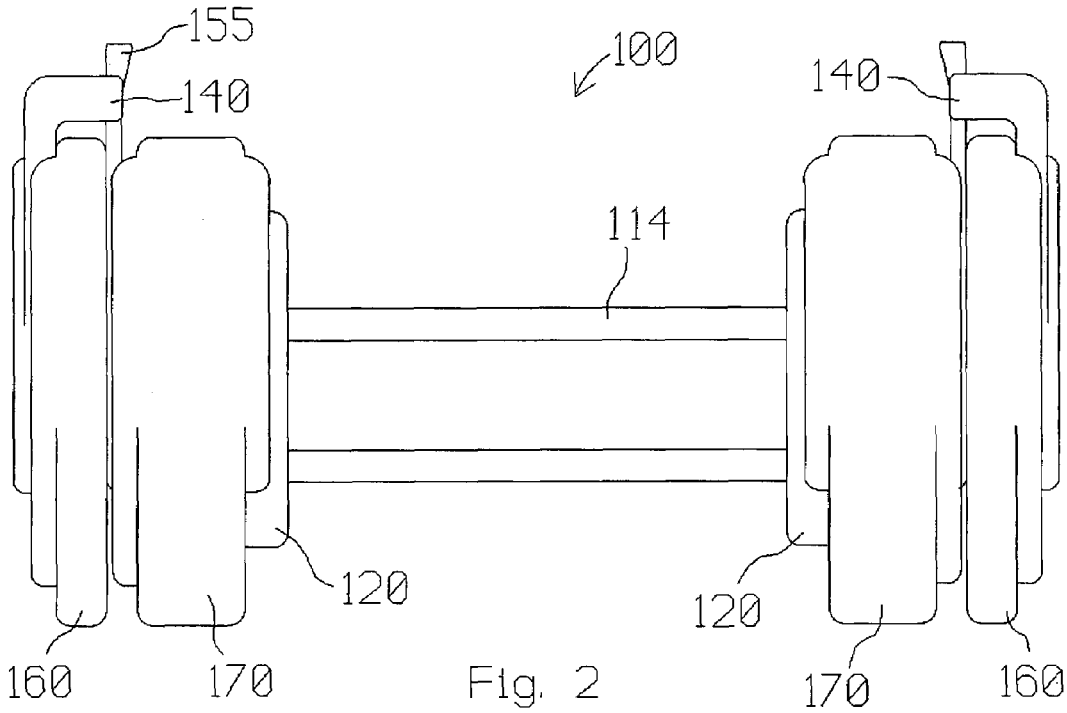
FIG. 2 is a side view of the dumbbell shown in FIG. 1.
Figure 3:
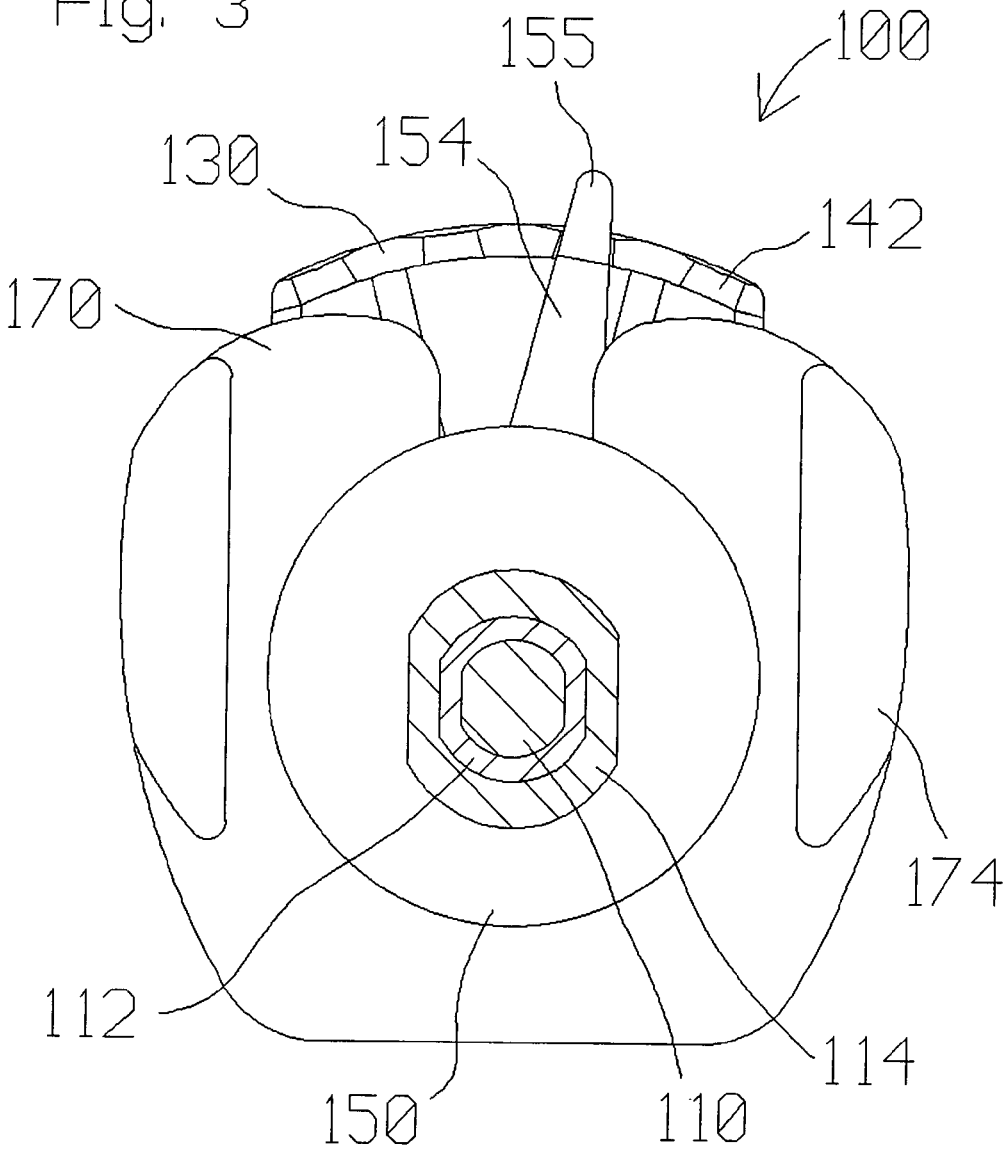
FIG. 3 is a sectioned end view of the dumbbell shown FIG. 1.

A preferred embodiment of the present invention may be described with reference to a dumbbell designated as 100 in FIGS. 1-3. The dumbbell 100 includes a bar 110 (labeled in FIG. 3) that extends substantially the entire length of the dumbbell 100 and defines a longitudinal axis. A hand grip is mounted on an intermediate portion of the bar 110, and respective weight housings or supports are mounted on opposite ends of the bar 110. The hand grip includes a rigid tubular member 112 that is preferably made of plastic and sized to fit snugly onto the bar 110, and a semi-rigid tubular member 114 that is preferably made of rubber and sized to fit onto the tubular member 112. As shown in FIG. 3, the bar 110 has a profile that may be described in terms of a "clipped cylinder" having a pair of diametrically opposed arcuate surfaces, and a pair of diametrically opposed, flat surfaces. This profile allows parts to be either keyed to the bar 110 or rotatably mounted on the bar 110.

The weight supports on the ends of the bar 110 may be described in terms of an inside wall or end plate 120, and an outside wall or end plate 130. Each inside end plate 120 is a circular plate or disc that is keyed onto the bar 110 and abuts a respective end of the hand grip. The plates 120 may be made of plastic, metal, a combination of the two materials, or any other suitable materials.

Figure 5:
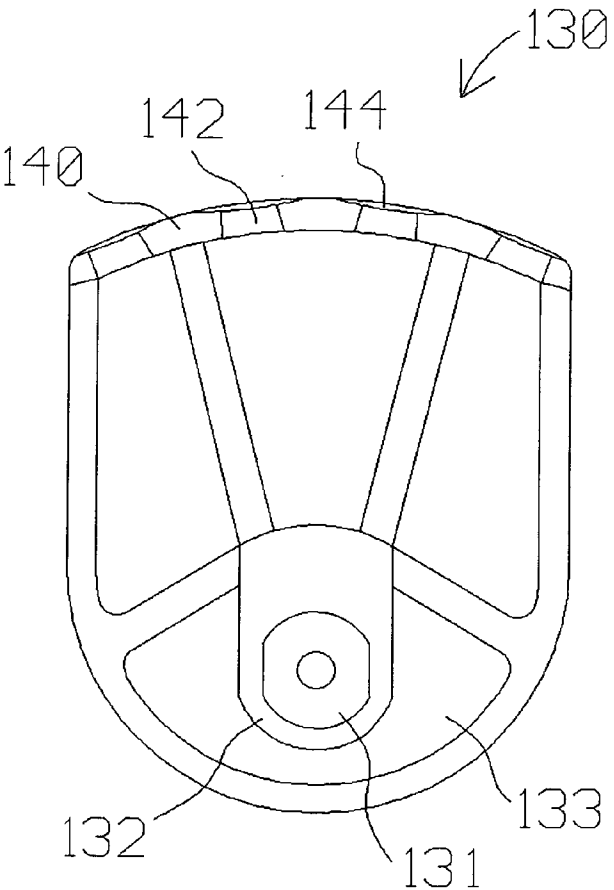
FIG. 5 is an opposite end view of the outer end plate shown in FIG. 4.
Figure 4:
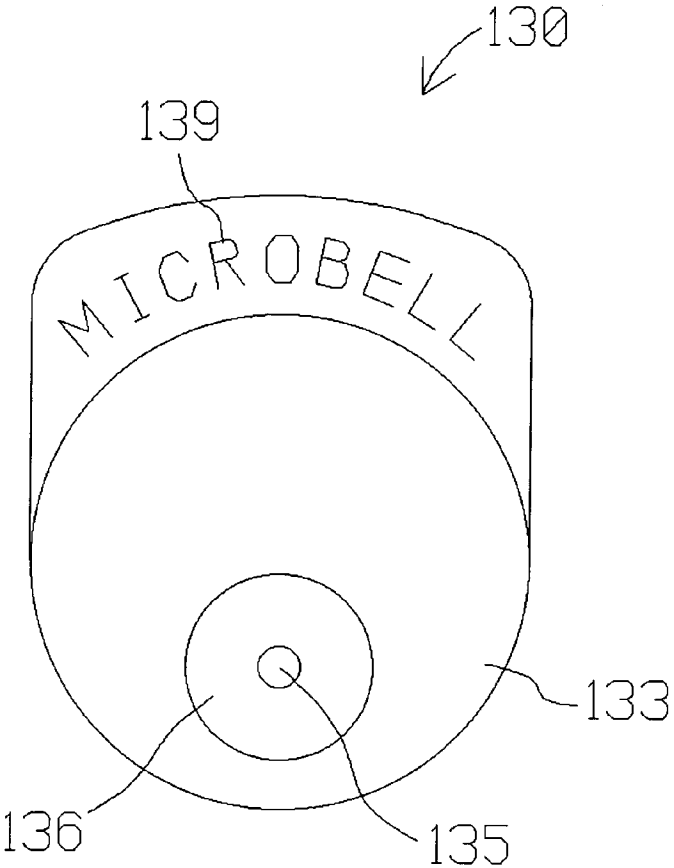
FIG. 4 is an end view of an outer end plate on the dumbbell shown in FIG. 1.
Figure 7:
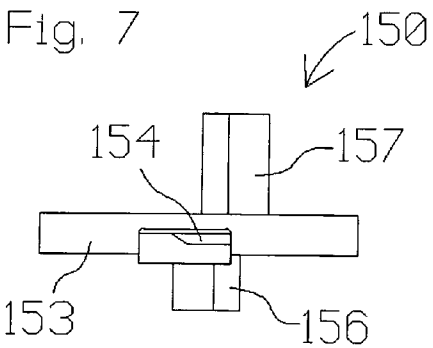
FIG. 7 is a top view of the weight selecting member shown in FIG. 6.
Figure 6:
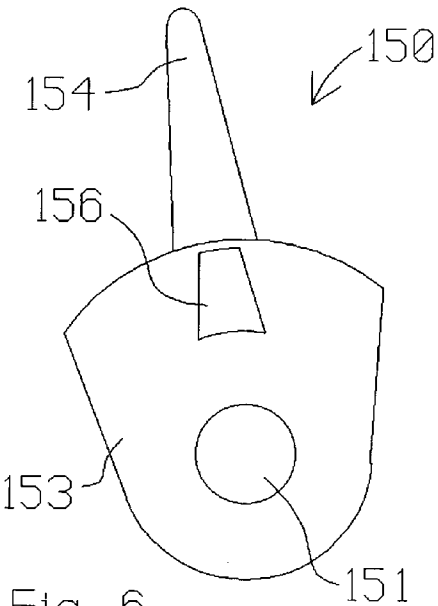
FIG. 6 is an end view of a weight selecting member on the dumbbell shown in FIG. 1.
Figure 8:
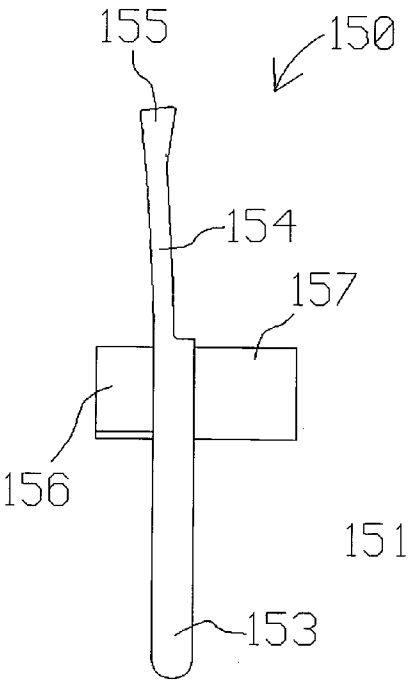
FIG. 8 is a side view of the weight selecting member shown in FIG. 6.
Figure 9:
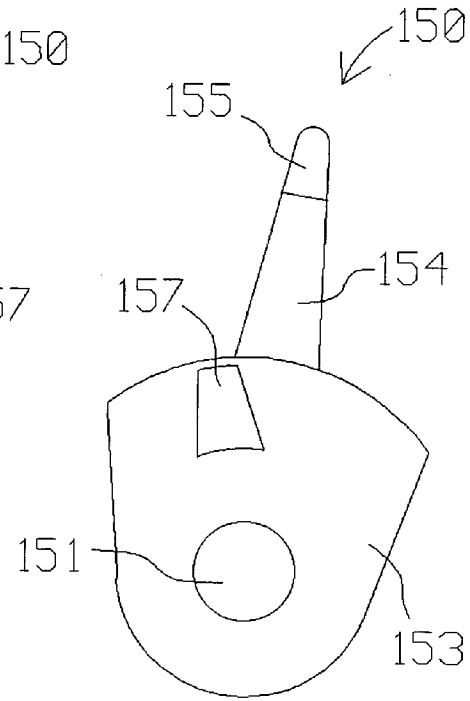
FIG. 9 is an opposite end view of the weight selecting member shown in FIG. 6.

One of the outside end plates 130 is shown by itself in FIGS. 4-5. The depicted end plate 130 includes a main wall or plate portion 133 that may be configured in various ways for aesthetic purposes, and that may be "cored" in various ways for structural integrity and/or material savings. The end plate 130 includes a circular portion superimposed over the lower portion of a tombstone-shape, and a product name 139 is displayed on the exposed, upper portion of the tombstone shape. A relatively small hole 135 extends through the end plate 130 to accommodate insertion of a fastener that is threaded into a respective end of the bar 110. Also, a depression 136 extends into the outer side of the end plate 130 to accommodate the end of the fastener in countersunk fashion. A hub 132 extends perpendicularly away from an opposite, inner side of the end plate 130, and an opening 131 in the hub 132 is sized and configured to fit snugly onto the bar 110.

Along the upper edge of the end plate 130, a lip or flange 140 extends perpendicularly away from the inner side of the end plate 130. Circumferentially spaced notches 142 are formed in the inward edge of the lip 140, and semi-circular depressions 144 are formed in the top of the lip 140 at positions that align with respective notches 142. Also, indicia 149 are disposed on the top of the lip at locations that align with respective notches 142.

On each end portion of the bar 110, a spacer 127 is keyed onto the bar 110 subsequent to a respective inner end plate 120. Each spacer 127 has the same profile as the hubs 132 on the end plates 130. Those skilled in the art will recognize that the spacers 127 may be formed as integral portions of the inner end plates 120, and/or the hubs 132 may be formed as separate parts, rather than integrated into the outer end plates 130.

Subsequent to a respective spacer 127, a weight selector 150 is rotatably mounted on each end of the bar 110. One of the weight selectors 150 is shown by itself in FIGS. 6-9. Each weight selector 150 includes a main wall or plate portion 153 having a profile that is bounded by a first arc at its lower end, by a second, larger diameter arc at its upper end, and by opposite side line segments extending between respective ends of the arcs. A circular hole 151 extends through the plate portion 153 and is sized and configured to receive the bar 110 in a manner that rotatably mounts the weight selector 150 on the bar 110.

A first catch or peg 156 extends perpendicularly away from a first or outer side of the plate portion 153, and a second catch or peg 157 extends perpendicularly away from an opposite, second or inner side of the plate portion 153. The pegs 156 and 157 have similar profiles but different lengths, and they occupy different sectors relative to the hole 151. Each peg 156 and 157 is bounded by a lower cylindrical surface that is configured and arranged to overlie and/or rest on a complementary upper surface on a respective spacer 127 or hub 132. Also, each peg 156 and 157 is bounded by an upper cylindrical surface that is configured and arranged to underlie and/or support a complementary surface on a respective weight plate 160 or 170, as further explained below.

A relatively thinner lever or leaf spring 154 extends radially away from the plate portion 153. The lever 154 terminates in a relatively thicker distal end or nub 155. The profile of the lever 154 is sized and configured to nest inside the profile of the notches 142 in the end plates 130, and the notches 142 define respective weight selecting orientations for the weight selector 150. The weight selector 150 is made of a resilient material, such as nylon, and the lever 154 is resiliently biased to enter and remain in a selected notch 142. In other words, the lever 154 must be pushed and/or pulled outward from a notch 142 in order to rotate the associated weight selector 150. FIGS. 1-3 show the levers 154 occupying respective notches 142 associated with weight indicia "3" on the outer end plates 130.

Figure 12:
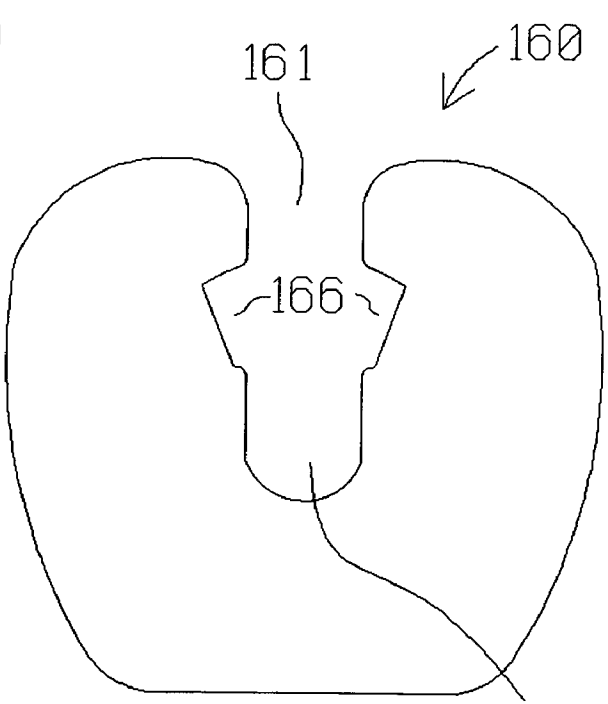
FIG. 12 is an opposite end view of the weight plate shown in FIG. 1.
Figure 11:
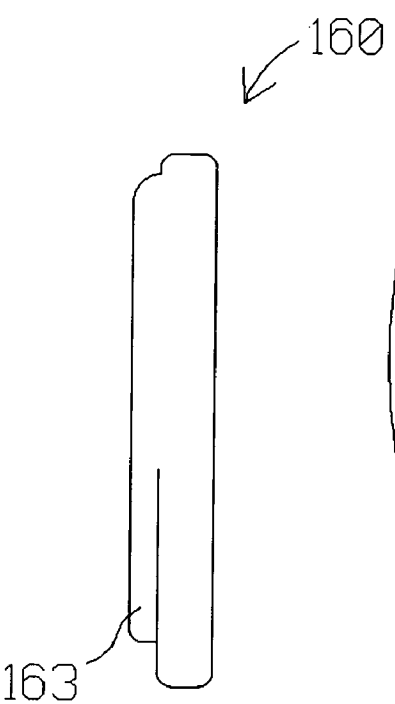
FIG. 11 is a side view of the weight plate shown in FIG. 10.
Figure 10:
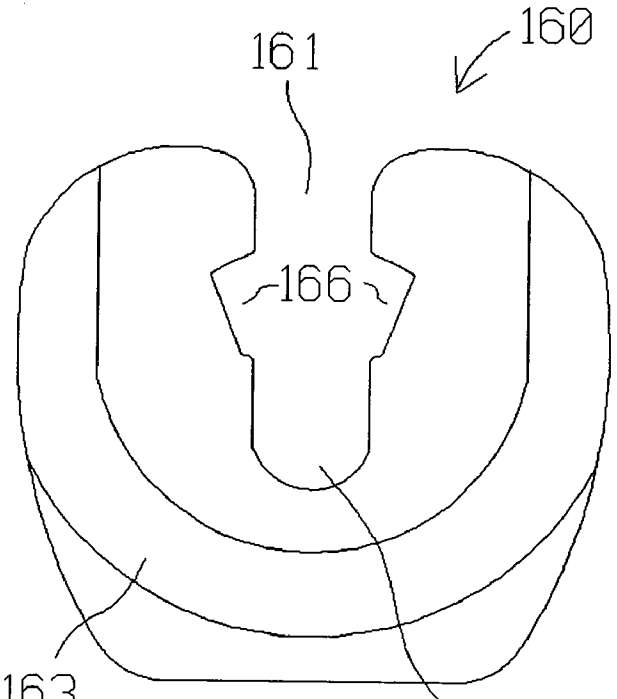
FIG. 10 is an end view of a relatively light weight plate on the dumbbell shown in FIG. 1.

One of the relatively smaller and lighter weight plates 160 is shown by itself in FIGS. 10-12. Each weight plate 160 may be described as a generally U-shaped plate having an upwardly opening slot 161. An inner or lower end portion 162 of the slot 161 is sized and configured to accommodate a respective hub 132 in a manner that prevents the weight plate 160 from rotating relative to the bar 110. Recognizing that the slot 161 effectively lowers the center of mass for the plate, it may be deemed desirable to make the slot extend downward past the center of the plate and/or to shape the plate with less mass at the bottom and/or more mass at the top, in order to provide a relatively balanced weight relative to the bar 110. In this regard, a U-shaped projection 163 extends outward from one side of the weight plate 160 both for balance purposes and to take advantage of available space within the outermost dimensions of the dumbbell 100. The projection 163 is configured and arranged to extend beneath the outer end plate 130, and above an end wall on a base 180 that is more fully described below.

First and second notches 166 extend into respective sidewalls of the slot 161. The notches 166 are mirror images of one another, and are configured and arranged to receive the peg 156 on a respective weight selector 150 when rotated to a respective orientation. Like the peg 156, the notches 166 are bounded by upper and lower arcuate edges that are centered about the longitudinal axis defined by the bar 110.

Figure 15:
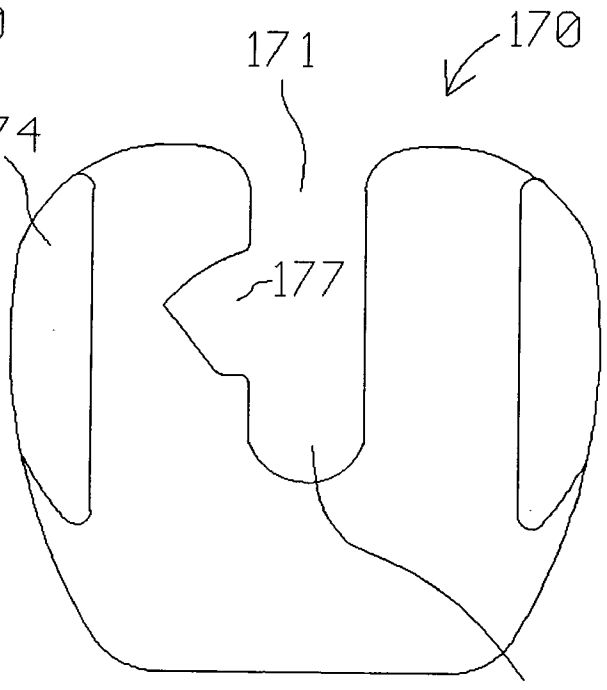
FIG. 15 is an opposite end view of the weight plate shown in FIG. 14.
Figure 14:
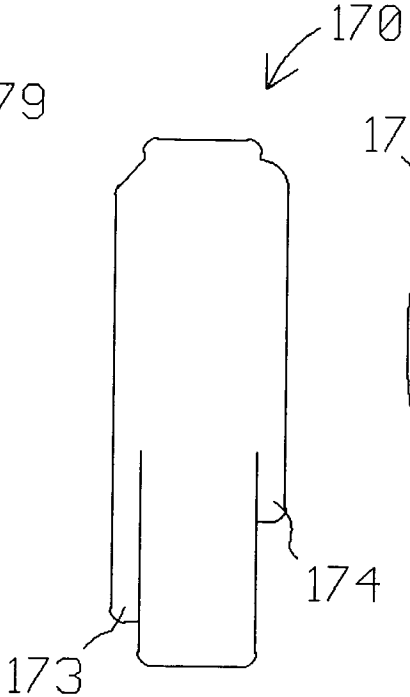
FIG. 14 is a side view of the weight plate shown in FIG. 13.
Figure 13:
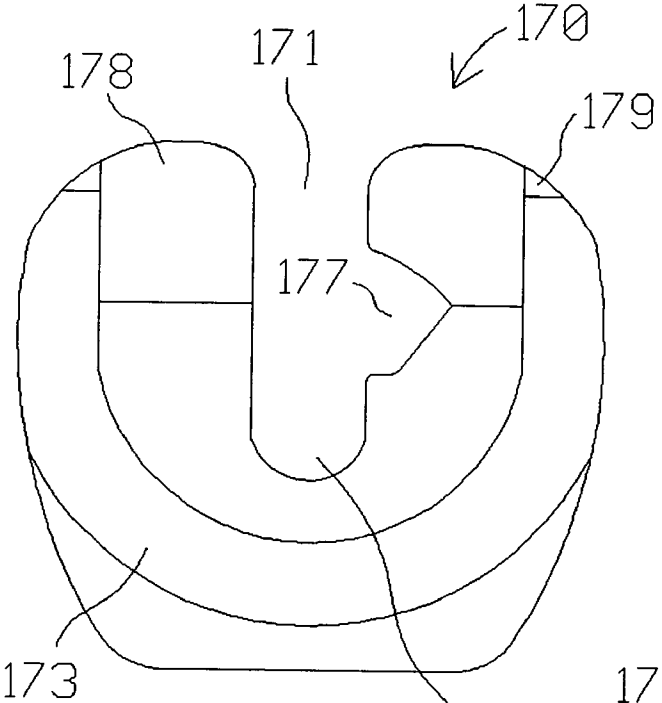
FIG. 13 is an end view of a relatively heavy weight plate on the dumbbell shown in FIG. 1.

One of the relatively larger and heavier weight plates 170 is shown by itself in FIGS. 13-15. Each weight plate 170 may be described as a generally U-shaped plate having an upwardly opening slot 171. An inner or lower end portion 172 of the slot 171 is sized and configured to accommodate a respective spacer 127 in a manner that prevents the weight plate 170 from rotating relative to the bar 110. As on the weight plate 160, a U-shaped projection 173 extends outward from one side of the weight plate 170. The projection 173 is configured and arranged to extend beneath the weight selector 150, and above an intermediate wall on the base 180 that is more fully described below. Also, for similar reasons, opposite side shoulders 174 extend outward from an opposite, second side of the weight plate 170. The shoulders 174 are configured and arranged to avoid interference with the inner end plates 120 and the base 180 that is more fully described below.

A notch 177 extends into one sidewall of the slot 171, and is configured and arranged to receive the peg 157 on a respective weight selector 150 when rotated to a respective orientation. The notch 177 may be described as a deeper version of one of the notches 166, and/or as being bounded by relatively longer arcuate edges centered about the longitudinal axis defined by the bar 110.

Figure 1:
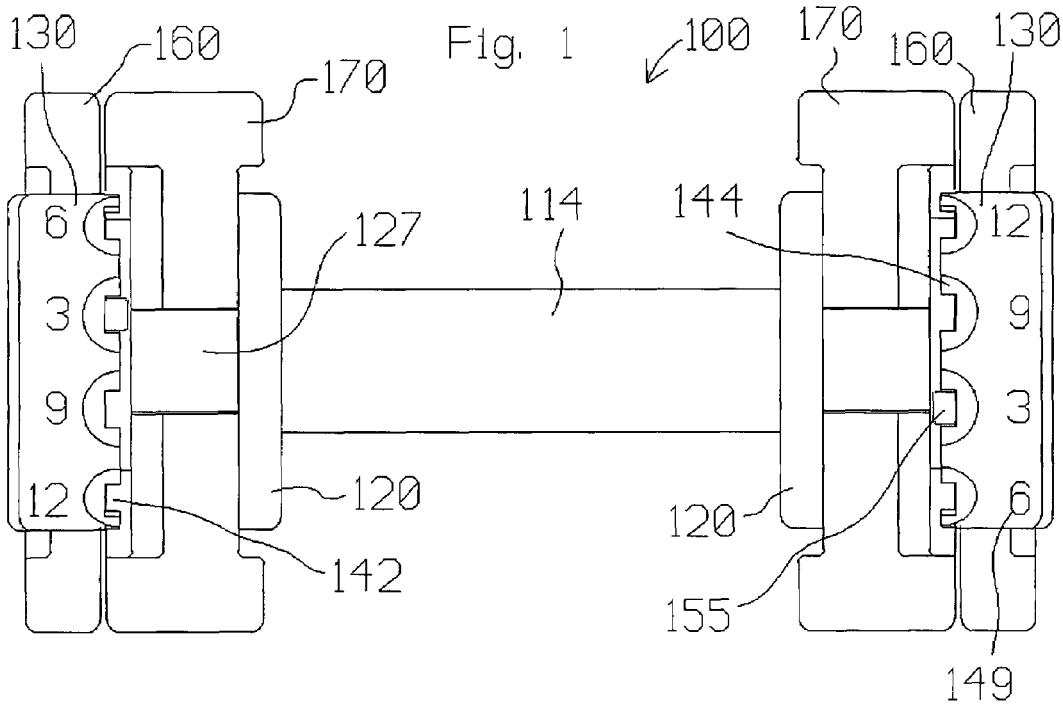
FIG. 1 is a top view of a dumbbell constructed according to the principles of the present invention.

When the weight selectors 150 are rotated to respective "3" positions as shown in FIG. 1, the pegs 156 and 157 occupy the slots 161 and 171 in respective weight plates 160 and 170. As a result, the handle assembly may be lifted upward without any of the weight plates 160 and 170 connected thereto. With the handle assembly made to weigh three pounds, the "3" weight indicia appropriately indicate that the empty handle assembly weighs three pounds.

When the weight selectors 150 are rotated to respective "6" positions, the pegs 156 rotate into respective notches 166 in the weight plates 160, and the pegs 157 rotate into different positions within the slots 171 in the weight plates 170. As a result, the handle assembly may be lifted upward together with the weight plates 160. With the weight plates 160 made to weigh one and one-half pounds each, the "6" weight indicia appropriately indicate that the handle assembly now weighs six pounds. An intermediate weight of four and one-half pounds may be obtained by moving one lever 154 to the "6" position, and leaving the other lever 154 at the "3" position.

When the weight selectors 150 are rotated to respective "9" positions, the pegs 157 rotate into respective notches 177 in the weight plates 170, and the pegs 156 rotate into different positions within the slots 161 in the weight plates 160 (as compared to the "3" positions). As a result, the handle assembly may be lifted upward together with the weight plates 170. With the weight plates made to weigh three pounds each, the "9" weight indicia appropriately indicate that the handle assembly now weighs nine pounds. An intermediate weight of seven and one-half pounds may be obtained by moving one lever 154 to the "6" position, and moving the other lever 154 to the "9" position.

When the weight selectors 150 are rotated to respective "12" positions, the pegs 157 rotate further into respective notches 177 in the weight plates 170, and the pegs 156 rotate into respective notches 166 in the weight plates 160. As a result, the handle assembly may be lifted upward together with all of the weight plates 160 and 170, and the "12" weight indicia appropriately indicate that the handle assembly now weighs twelve pounds. An intermediate weight of ten and one-half pounds may be obtained by moving one lever 154 to the "9" position, and moving the other lever 154 to the "12" position.

Figure 16:
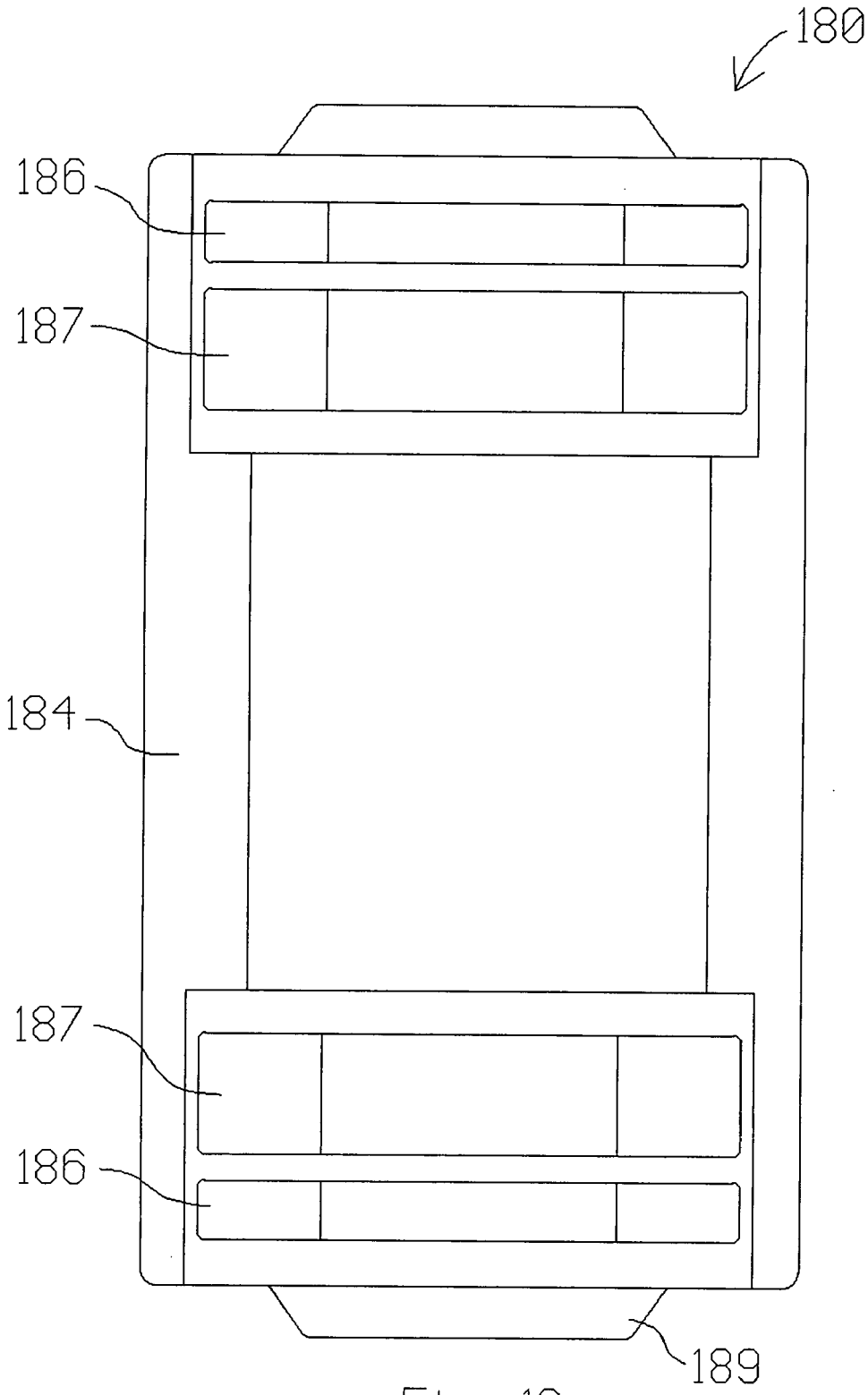
FIG. 16 is a top view of a base that is sized and configured to support the weight plates in the same relative positions as on the dumbbell shown in FIG. 1.

When not in use, the weight plates 160 and 170 rest on a base or cradle designated as 180 in FIG. 16. The cradle 180 includes an intermediate portion 184, and upwardly opening boxes secured to opposite ends of the intermediate portion 184. Each box is divided into a relatively smaller compartment 186 that is sized and configured to receive a weight plate 160, and a relatively larger compartment 187 that is sized and configured to receive a weight plate 170. The base 180 maintains the weights 160 and 170 in the same alignment as the handle assembly. Handles or lips 189 project outward from the ends of the cradle 180 to facilitate lifting of the cradle 180 with the dumbbell 100 stored thereon.

Additional embodiments of the present invention may be implemented with different weight plates and/or different weight selector configurations. For example, the notch configurations associated with the weights 160 and 170 may be switched with relatively little modification to the remainder of the dumbbell 100. In another variation, the weight plates 160 and 170 may be modified to have the relatively larger notch 177 formed in each sidewall of respective slots 161 and 171, and the weight selector at one end may be made as the mirror image of a weight selector 150 at the opposite end. These changes would accommodate common lever orientations at respective ends of the dumbbell for a given weight indicia amount.

Figure 17:
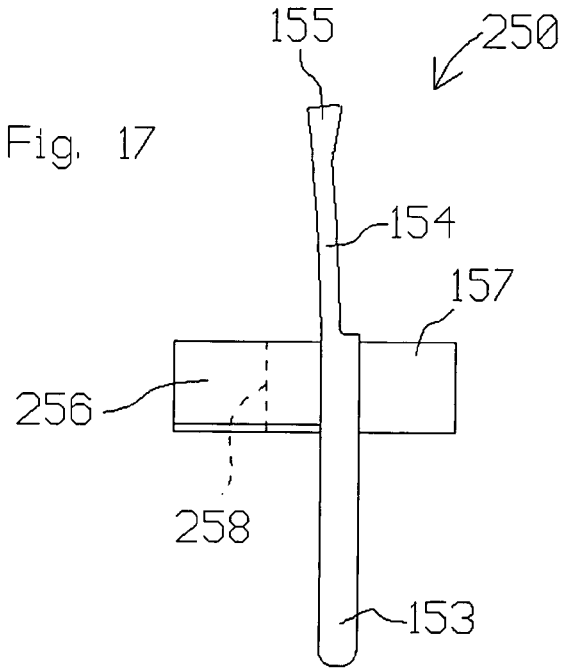
FIG. 17 is a side view of an alternative embodiment weight selector.

With reference to another alternative embodiment, FIG. 17 shows an alternative embodiment weight selector 250 that is similar to the weight selector 150 shown in FIGS. 6-9, except that the peg 256 is longer than the peg 156. For comparison purposes, the dashed line 258 shows where the peg 156 terminates on the weight selector 150. The extended peg 256 is sized and configured to span two weight plates and overlie the hubs and/or spacers associated therewith, as further explained below, and may be further extended to be supported by structure on a handle assembly end plate, especially when rotated to an extreme orientation. On this embodiment, a weight spacer and weight divider is positioned between the intermediate weight plate and the outermost weight plate in order to maintain proper alignment of the weight plates.

Figure 18:
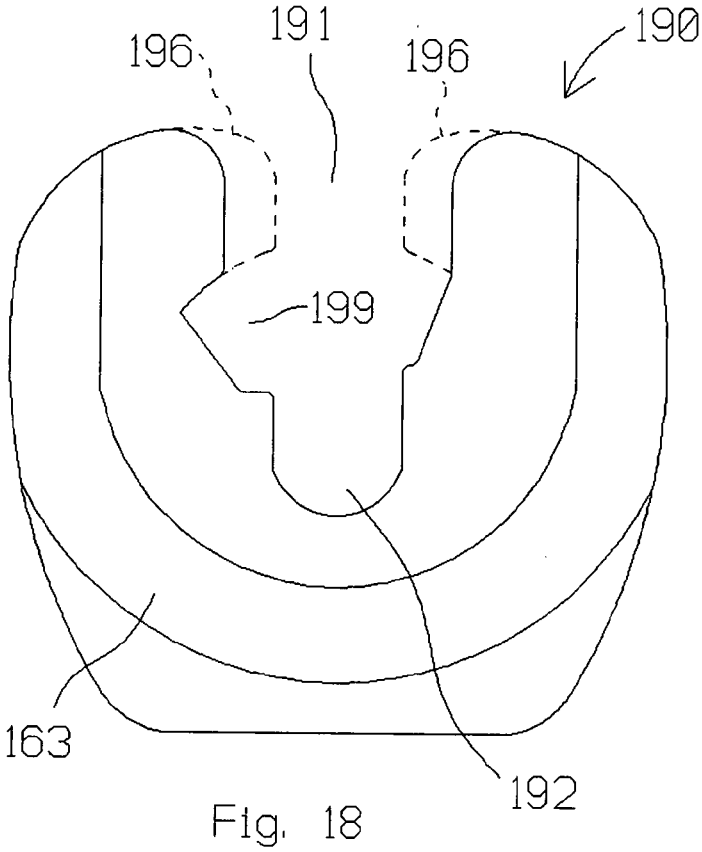
FIG. 18 is an end view of an alternative embodiment weight plate.

FIG. 18 shows one of two weight plates 190 that are configured for use together with the weight selectors 250 on an alternative embodiment dumbbell. The weight plate 190 may be described as a generally U-shaped plate having a U-shaped projection 163, and an upwardly opening slot 191. An inner or lower end portion 192 of the slot 191 is sized and configured to accommodate a respective hub 132 (or a comparably sized spacer) in a manner that prevents the weight plate 190 from rotating relative to the bar 110. An upper end portion of the slot 191 is wider than the slots 161 and 171 on respective weight plates 160 and 170. For comparison purposes, the dashed lines 196 show the edges of the weight plates 160 and 170 when aligned with the weight plate 190. In other words, the slot 191 is sized and configured to allow passage of the peg 256 when inside either notch 166 in the weight plate 160.

A notch 199 extends into a first sidewall of the slot 191, and is configured and arranged to receive the peg 256 on a respective weight selector 250 when rotated to a relatively more extreme position than those shown on the dumbbell 100. In this regard, the dumbbell 100 must be modified to accommodate a fifth lever position, and the weight plates 160 and 170 must be modified, as well. In particular, a notch must be formed in an opposite sidewall of the slot 171, and a relatively deeper notch must be formed in the corresponding sidewall of the slot 161, both of which are configured and arranged to align with the notch 199 in the slot 191.

On this alternative embodiment dumbbell, the lever is rotated past the "6" position to a "15" position in order to connect all three weight plates to the handle assembly. With the weight plates 190 made to weigh one and one-half pounds each, the "15" weight indicia appropriately indicates that the fully loaded, modified handle assembly weighs fifteen pounds. An intermediate weight of thirteen and one-half pounds may be obtained by moving one lever to the "12" orientation, and moving the other lever to the "15" orientation.

With reference to yet another alternative embodiment, a weight selector may have a single peg that extends in a single direction away from the plate portion of the weight selector and spans first and second weight plates weighing one and one-half pounds and three pounds, respectively. One such weight plate may have a notch in one slot sidewall, and an expanded slot width created by removing material associated with an opposite slot sidewall. The other such weight plate may have the same configuration, but with a shallower notch in the one slot sidewall, and a comparable notch provided in the opposite slot sidewall, as well. This arrangement similarly accommodates selection of any combination of the two weight plates. On this embodiment, a weight divider is preferably integrally joined to a weight spacer associated with one of the plates, and is configured and arranged to occupy space between adjacent weight plates without interfering with rotation of the peg.

The foregoing description and accompanying figures disclose only some of the many conceivable embodiments to be constructed in accordance with the principles of the present invention. Other embodiments, methods, and/or variations will become apparent to those skilled in the art as a result of this disclosure. Moreover, those skilled in the art will recognize that aspects and/or one or more features of various methods and embodiments may be mixed and matched in numerous ways to arrive at still more variations of the present invention. In view of the foregoing, the scope of the present invention is to be limited only to the extent of the following claims.

What is claimed is:

1. An adjustable weight exercise device, comprising:

a base;

a first set of weights including a first weight plate and a second weight plate maintained in alignment at a first end of the base, and a second set of weights including a first weight plate and a second weight plate maintained in alignment at an opposite, second end of the base, wherein each said first weight plate has an upwardly opening slot, and a first notch and a second notch that extend into opposing sidewalls of the slot, and each said second weight plate has an upwardly opening slot, and at least one notch that extends into a sidewall of the slot; and a handle member having an intermediate hand grip that is sized and configured for grasping; opposite end portions that align with respective weight plates on the base; and first and second weight selectors that are rotatably mounted on respective end portions, wherein each of the weight selectors extends at least partially through each said weight plate in a respective set, and each of the weight selectors is rotatable from a first orientation disposed entirely outside each said notch, to a second orientation extending into only one said notch in the first weight plate, to a third orientation extending into only one said notch in the second weight plate, to a fourth orientation extending into both an opposite said notch in the first weight plate, and the one said notch in the second weight plate.

2. The adjustable weight exercise device of claim 1, wherein the weight selectors are sized and configured for insertion between the first weight plate and the second weight plate in a respective set.

3. The adjustable weight exercise device of claim 1, wherein each of the weight selectors includes a leaf spring that is biased to remain latched in any said orientation relative to the handle member.

4. The adjustable weight exercise device of claim 1, further comprising weight indicia on the handle member that align with each said orientation of the weight selectors.

5. The adjustable weight exercise device of claim 1, wherein each of the weight selectors includes a strip that enters a respective notch on the handle member for each said orientation.

6. The adjustable weight exercise device of claim 1, wherein each said first weight plate weighs one-half as much as each said second weight plate.

7. The adjustable weight exercise device of claim 1, further comprising a latching means for latching the weight selectors in any said orientation.

8. The adjustable weight exercise device of claim 1, wherein each of the weight selectors includes a first peg that is configured and arranged to enter the notches in the first weight plate, and a second peg that is configured and arranged to enter the at least one notch in the second weight plate.

9. The adjustable weight exercise device of claim 8, wherein the first peg and the second peg are circumferentially offset from one another.

10. The adjustable weight exercise device of claim 8, wherein the first peg and the second peg extend in opposite directions away from a divider portion of a respective weight selector.

11. An adjustable weight exercise device, comprising:

a first weight plate configured and arranged to define an upwardly opening slot and a laterally extending notch that opens into a sidewall of the slot;

a second weight plate configured and arranged to define an upwardly opening slot and a laterally extending notch that opens into a sidewall of the slot in the second weight plate;

a weight lifting member configured and arranged to support the first weight plate and the second weight plate in alignment with one another, with the notch in the first weight plate extending in a first direction away from each said slot, and the notch in the second weight plate extending in an opposite, second direction away from each said slot; and a weight selecting member rotatably mounted on the weight lifting member, wherein at least one peg projects outward from the weight selecting member and at least partially through each said weight plate, and the at least one peg is configured and arranged to (a) occupy only the slot in each said weight plate when the weight selecting member occupies a first orientation relative to the weight lifting member, thereby accommodating upward movement of the weight lifting member relative to each said weight plate, and (b) occupy the notch in the first weight plate and the slot in the second weight plate when the weight selecting member occupies a second orientation relative to the weight lifting member, upon rotation in a first direction away from the first orientation, thereby accommodating upward movement of the weight lifting member and the first weight plate relative to the second weight plate, and (c) occupy the slot in the first weight plate and the notch in the second weight plate when the weight selecting member occupies a third orientation relative to the weight lifting member, upon rotation in an opposite, second direction away from the first orientation, thereby accommodating upward movement of the weight lifting member and the second weight plate relative to the first weight plate.

12. The adjustable weight exercise device of claim 11, wherein a portion of the weight selecting member is sized and configured for insertion between the first weight plate and the second weight plate.

13. The adjustable weight exercise device of claim 11, wherein the weight selecting member includes a first peg that is configured and arranged to enter the notch in the first weight plate, and a separate, second peg that is configured and arranged to enter the notch in the second weight plate.

14. The adjustable weight exercise device of claim 13, wherein the first peg and the second peg are circumferentially offset from one another about an axis of rotation defined by rotating of the weight selecting member.

15. The adjustable weight exercise device of claim 13, wherein a portion of the weight selecting member is configured for insertion between the first weight plate and the second weight plate, and the first peg and the second peg extend in opposite directions away from said portion.

16. An adjustable weight exercise device, comprising:

a first weight plate configured and arranged to define an upwardly opening slot and a laterally extending notch that opens into a sidewall of the slot;

a second weight plate configured and arranged to define an upwardly opening slot and a laterally extending notch that opens into a sidewall of the slot, wherein the notch in the first weight plate extends laterally further than the notch in the second weight plate;

a weight lifting member configured and arranged to support the first weight plate and the second weight plate in alignment with one another, with the notch in each said weight plate extending in a common direction away from each said slot; and a weight selecting member rotatably mounted on the weight lifting member, wherein at least one peg projects outward from the weight selecting member and at least partially through each said weight plate, and the at least: one peg is configured and arranged to (a) occupy the slot in each said weight plate when the weight selecting member occupies a first orientation relative to the weight lifting member, thereby accommodating upward movement of the weight lifting member relative to each said weight plate, and (b) occupy a first portion of the notch in the first weight plate and the slot in the second weight plate when the weight selecting member occupies a second orientation relative to the weight lifting member, upon rotation of the weight selecting member in a first direction away from the first orientation, thereby accommodating upward movement of the weight lifting member and the first weight plate relative to the second weight plate, and (c) occupy the notch in the second weight plate and a second portion of the notch in the first weight plate when the weight selecting member occupies a third orientation relative to the weight lifting member, upon further rotation of the weight selecting member in the first direction, thereby accommodating upward movement of the weight lifting member together with each said weight plate.

17. The adjustable weight exercise device of claim 16, wherein a portion of the weight selecting member is sized and configured for insertion between the first weight plate and the second weight plate.

18. The adjustable weight exercise device of claim 16, wherein the weight selecting member includes a first peg that is configured and arranged to enter the notch in the first weight plate, and a separate, second peg that is configured and arranged to enter the notch in the second weight plate.

19. The adjustable weight exercise device of claim 18, wherein the first peg and the second peg are circumferentially offset from one another about an axis of rotation defined by rotating of the weight selecting member.

20. The adjustable weight exercise device of claim 18, wherein a portion of the weight selecting member is configured for insertion between the first weight plate and the second weight plate, and the first peg and the second peg extend in opposite directions away from said portion.

* * * * *